United States Patent [19]

Gijbels et al.

[11] Patent Number: 4,503,816

[45] Date of Patent: Mar. 12, 1985

[54] COMBUSTION ENGINE WITH A CONSTANT COMBUSTION VOLUME

[76] Inventors: Peter H. Gijbels, Spoorwegstraat 8, 3590 Hamont-Achel; Jozef M. Gijbels, Tramlaan 148, 1960 Sterrebeek, both of Belgium

[21] Appl. No.: 497,258

[22] Filed: May 23, 1983

[30] Foreign Application Priority Data

May 28, 1982 [BE] Belgium ..... 893338

[51] Int. Cl.[3] ..... F02B 25/12

[52] U.S. Cl. ..... 123/53 AA; 123/654

[58] Field of Search ..... 123/53, 59 EC, 654; 60/622

[56] References Cited

U.S. PATENT DOCUMENTS

| | | | |
|---|---|---|---|
| 727,455 | 5/1903 | Rumpf | 123/59 A |
| 1,273,834 | 7/1918 | Dumanois | 123/53 A |
| 1,347,087 | 7/1920 | Gernandt | 60/622 |
| 1,687,348 | 9/1928 | Platt | 123/53 A |
| 1,867,680 | 7/1932 | Scharnagel | 123/53 A |
| 1,892,635 | 12/1932 | Schwarz | 123/53 A |
| 2,280,487 | 4/1942 | Heylandt | 60/622 |
| 4,075,980 | 2/1978 | Anger | 123/59 EC |
| 4,157,080 | 6/1979 | Hill | 123/59 EC |
| 4,169,435 | 10/1979 | Faulconer, Jr. | 123/48 A |
| 4,327,701 | 5/1982 | Gerry | 123/654 |

FOREIGN PATENT DOCUMENTS

| | | | |
|---|---|---|---|
| 2122523 | 11/1972 | Fed. Rep. of Germany . | |
| 593146 | 8/1925 | France . | |
| 14341 | of 1884 | United Kingdom | 123/53 AA |

*Primary Examiner*—Craig R. Feinberg

*Attorney, Agent, or Firm*—Collard, Roe & Galgano

[57] ABSTRACT

A combustion engine with a constant combustion volume is provided having three cylinders in which two cylinders work in four stroke and one cylinder in two stroke. It is especially designed to greatly increase the actual total useful effect $\eta_t$ of the engine and thus saving large quantities of fuel. Only the four stroke cylinders have a normal combustion chamber in their engine covers. The piston of the two stroke cylinder is always advanced in front of the other pistons over an arc $\alpha$ of about 45° and goes to its engine cover. The pistons of the four stroke cylinders are displaced over an arc of 360°, to feed alternately the other cylinder. The two four stroke cylinders are connected to the two stroke cylinder by one-way or repercussion valves which are activated at the time of ignition to transfer a portion of the burning gases to the two stroke cylinder.

5 Claims, 1 Drawing Figure

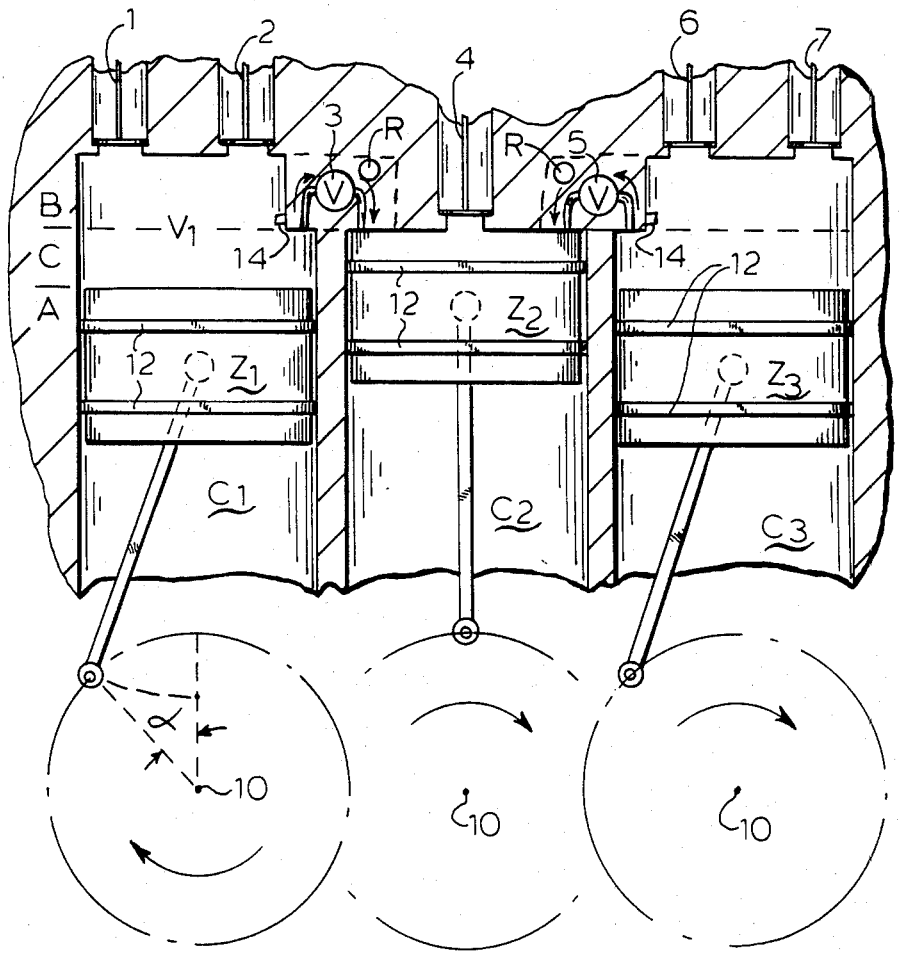
1
2
4
6
7
3
R
R
5
B
C
A
V1
14
14
12
12
12
Z1
Z2
Z3
C1
C2
C3
α
10
10
10

COMBUSTION ENGINE WITH A CONSTANT COMBUSTION VOLUME

The invention relates to economize important quantities of fuel, by seriously increasing the total useful effect of a combustion engine.

The useful effect of a combustion engine is given by the formula $\eta_t = \eta_{th} \cdot \eta_m \cdot \eta_i$ in which:

$\eta_{th}$ = thermal effect, $\eta_m$ = mechanical effect, and $\eta_i$ = interior effect. To economize important quantities of fuel, we have thus to increase the values of the terms $\eta_{th}$ and (or) $\eta_m$ and (or) $\eta_i$.

The thermal effect $\eta_{th}$ can be significantly increased in performing combustion in a constant volume.

In a diagram concerning the useful thermal effect as a function of the compression ratio of an engine, there are two limit-lines for a whole series of possible pressures. The upper limit curve concerns combustion in a volume which remains constant, and the lower limit curve concerns combustion under constant pressure. We see on this diagram that for a compression ratio of 8, with a combustion in a constant volume, the thermal useful effect increases by 35% and more, in comparison to the useful thermal effect of the same engine where the combustion takes place under constant pressure.

In order to calculate the input energy, in actual engines in which the pressure remains nearly constant during combustion, the formula $Q_1 = C_p\ (T_2 - T_1)$, is used in which: $T_1$ = end-compression temperature, $T_2$ = the end combustion temperature, and $C_p$ = specific heat of air at constant pressure ($C_p$ = 1,000 J/kg/°C.).

For a CCV-engine (Combustion in a Constant Volume), the formula becomes $Q_2 = C_v(T_2 - T_1)$, in which: $C_v$ = specific heat of air by combustion in a permanently constant volume ($C_v$ = 710 J/kg/°C.).

To obtain the same end combustion temperature $T_2$, a much smaller heat $Q_2$ is applied to a CCV-engine, because $C_v < C_p$, economizing 1,000−710=290, or 29%.

Consulting the T-s diagram of the output gases, with a CCV-engine with the same end combustion temperature $T_2$, one can obtain a much higher pressure than with the end combustion temperature $T_2$ of an engine in which the combustion occurs under constant pressure.

The mechanical useful effect $\eta_m$ can be increased making the power arm of the couple as great as possible, when the pressure is high.

The internal useful effect $\eta_i$ of an engine can be significantly increased by: reducing the mechanical energy for compression, and increasing the expansion with regard to the compression.

One way of carrying out the invention is described in detail below with reference to FIG. 1, which illustrates only one specific embodiment designed for complete combustion in a constant volume, and to increase as far as possible the terms $\eta_m$ and $\eta_i$.

Referring to FIG. 1, there is shown the CCV-engine consisting of a three cylinder unit. Their mechanisms are coupled to the same crankshaft, designated 10. For a six to one compression ratio, the mechanism of the cylinder $C_2$ is advanced in front of the others over an arc $\alpha$ of approximately 45 degrees, taking into account the first fault of a piston-rod-crankshaft mechanism. For a greater compression ratio, the arc $\alpha$ diminishes.

The cylinders $C_1$ and $C_3$ both have a normal combustion chamber (dead volume) in the engine head. Cylinder $C_2$ has no combustion chamber because piston $Z_2$ travels to the engine head. Valves 2 and 6 are inlet valves and valves 1, 4 and 7 are exhaust valves. These valves may be operated by a cam mechanism in the usual manner of a combustion engine so that the intake valves are open during the intake stroke of the cylinders and the exhaust valves are open during the exhaust stroke of the cylinders. Numeral 12 designates seals such as piston rings, normally found in such engines. Typical and particularly in a CCV-engine, are two one-way valves 3 and 5 (repercussion valves). These are very special valves built with materials resisting very high temperatures (monocarbids, titanium dioxide or the special material used on the shields of the space shuttle, etc.). These valves can be driven electrically, mechanically, or spontaneously by the pressure itself in cylinders $C_1$ and $C_3$. They are half cooled valves and may be provided with a glow element, designated 14, to ignite the injected fuel.

When piston $Z_1$ reaches level A in FIG. 1, piston $Z_2$ is already in its top dead center (level B) because its mechanism is advanced over an arc $\alpha$. The volume above piston $Z_2$ is at that moment minimal, but the volume $V_1$ above piston $Z_1$ is then twice as big as the normal combustion chamber of an ordinary engine. Tests have proved that in an engine with a pre-ignition of 45 to 60 degrees at low speed, the combustion volume must be at least two times larger in order to obtain a normal work pressure at the end of the combustion.

Cylinder $C_1$ is connected to cylinder $C_2$ by means of repercussion or one-way valve 3. As the crankshaft moves further in the direction of the arrows, piston $Z_1$ will rise and piston $Z_2$ moves down. Consequently, the volume above piston $Z_1$ gets smaller, and that above piston $Z_2$ increases.

When piston $Z_1$ stops at level B and begins its return, piston $Z_2$ is at level A. The volumes above the pistons are now together equal to the volume $V_1$, the volume above the piston $Z_1$ when it is situated at level A. The total combustion volume in the CCV-engine thus remains constant as the engine rotates over 45°. In an ordinary engine, this is only true over about 10°, five before and five degrees after top dead center.

In the next cycle of operation, the combustion takes place and pistons $Z_1$ and $Z_2$ move between levels A and B. The fuel injector injects through an opening R, its fuel directly into cylinder $C_1$. A part of this fuel-spray strikes over the heated glow element of one-way valve 3. When the very small fuel particles pass over the hot surface, they are pulverized, gasified and spontaneously ignited.

Since the beginning of the injection determines the moment of ignition, and the combustion must be in full action as piston $Z_1$ reaches level A, the normal injection has to begin 15° to 20° earlier or at about 60° before top dead center at normal speed (i.e., 3,000 revolutions per minute) of the CCV-engine.

As soon as the repercussion valve 3 opens, hot burning gases stream out of the cylinder $C_1$ into the cylinder $C_2$. The pressure which increases due to combustion is now equal upon both the pistons, since their rods are coupled to the same crankshaft, similar to two equal weights on the scales of a balance.

In the meantime, the power arm of the developed couple $K_1$ diminishes in cylinder $C_1$ and the power arm of the couple $K_2$ developed in cylinder $C_2$ increases. The couple K is determined by multiplying the pressure by the piston surface, multiplied by the powerarm. The value of the powerarm depends on the constantly changing angle between the connecting rod and the vertical.

A certain work $L_1$ must be provided during the first combustion to move the pistons from their levels A and B into their middle position C. This is the equilibrium point of the theoretical balance, wherein the pressures and power arms of couples $K_1$ and $K_2$ are, at this point, exactly the same. Likewise, in this middle position C, the total combustion volume is equal to $V_1$. From the middle position in level C, the power arm of couple $K_2$ increases more and more, whereas the power arm of couple $K_1$ diminishes until its value zero is reached, as piston $Z_1$ approaches level B, its top dead center.

Because the pressure always increases during combustion, the delivered work $1_2$ of couple $K_2$, is now considerably larger than the absorbed work $1_1$ of couple $K_1$. The work $L_2 = 1_2 - 1_1$ delivered by the two couples together over the arc $\alpha/2$ is positive and bigger than $L_1$. The CCV-engine thus delivers a positive work $L = L_2 - L_1$, while the pistons simultaneously move between levels A and B.

As piston $Z_1$ starts from level B, meanwhile piston $Z_2$ passes level A, the combustion is then practically finished. Both of the cylinders now have the same load of high pressure gases, and the simultaneous expansions begin. A piston $Z_2$ arrives in its bottom dead center, exhaust valve 4 opens and the exhaust gases can escape out of cylinder $C_2$. Afterwards, piston $Z_2$ pushes all remaining gases out of its cylinder $C_2$.

In the meantime, the piston $Z_3$ has completed its compression stroke and the injected fuel is already ignited. One-way valve 5 opens and the burning gases flow out of cylinder $C_3$ into the cylinder $C_2$ to work upon the piston $Z_2$.

The above-described cycle repeats itself, while the cylinder $C_1$ lets its exhaust gases escape and piston $Z_1$ pushes the remaining gases out of the cylinder, once again, to start its next cycle. Cylinder $C_2$ is thus alternatively fed by cylinders $C_1$ and $C_3$ from which the mechanisms are displaced over an arc of 360°.

After cylinder $C_2$ is loaded, one-way valves 3 and 5 may be rapidly closed because they are heated up very quickly in an opened position. During their closed position, the locking elements must dissipate their superfluous heat on their cooled seats. The locking elements of one-way valves 3 and 5 open alternately over an arc less than 100° in two revolutions (720°). They are strongly heated over a small period, but cooled over a long period of 600°.

It is clear that cylinder $C_2$ works as an ordinary steam cylinder, which per revolution, is filled and carries out one work stroke, whereas the cylinders $C_1$ and $C_3$ alternately, carry out only one work stroke every two revolutions. The CCV-engine is thus a combined four stroke-two stroke engine, in which cylinder $C_2$ delivers a power at least twice that of the other cylinders $C_1$ and $C_3$ together.

Since second piston $Z_2$ is advanced over an arc $\alpha$ in front of the pistons $Z_1$ and $Z_3$, the moment that the pressure is maximum in the second cylinder $C_2$, the power arm of its couple $K_2$ approaches its maximum value. This significantly increases the mechanical useful effect $\eta_m$ of the new engine. The six-to-one pre-compression ratio of the intake air absorbs a small amount of compression work. Subtracting herefrom the higher mentioned positive work L, one can obtain the real compression work provided by the CCV-engine, which is substantially smaller than the work provided by the 13 to 1 compression ratio of a diesel engine. For this reason, the internal useful effect $\eta_i$ of a CCV-engine is much higher than that of a diesel engine.

What is claimed is:

1. A reciprocating combustion engine comprising:

(a) a first cylinder wherein combustion takes place including a piston, intake and exhaust valve means, a fixed combustion chamber defining a combustion volume of said first cylinder and about one-half a total volume of combustion gases, and fuel injection and ignition means;

(b) a second cylinder having a displacement equal to said first cylinder including a piston and exhaust valve means;

(c) valve means interconnecting said first and second cylinders adapted to transfer one half of the combustion gases of said combustion in said first cylinder to said second cylinder during said combustion, whereby the total combustion volume of said engine is double that of said first cylinder; and wherein pre-ignition in said first cylinder is between about 45° and 60° before top dead center at about 3000 revolutions per minute and increases with higher engine speed and said second cylinder is advanced in rotation from said first cylinder by about 45°.

2. The reciprocating combustion engine as defined in claim 1, wherein the piston of said second cylinder is advanced in rotation relative to the piston of said first cylinder so that the combustion volume of said engine remains constant throughout said combustion in said first cylinder.

3. The reciprocating combustion engine as defined in claim 1 which further comprises a third cylinder identical to said first cylinder having valve means interconnecting said second and third cylinders adapted to transfer one-half of the gases of combustion in said third cylinder to said second cylinder during combustion in said third cylinder, said second cylinder alternately receiving combustion gases from said first and third cylinders.

4. The combustion engine as defined in claim 3, wherein cycles of said first and third cylinders are displaced by 360° and the piston of said second cylinder is advanced from said first and third cylinders by about 45°.

5. The combustion engine as defined in claim 3, wherein a plurality of said three cylinder units are mutually continuously coupled together to form a powerful engine.

* * * * *